US005654066A

United States Patent [19]

Pacione

[11] Patent Number: 5,654,066

[45] Date of Patent: Aug. 5, 1997

[54] CARPET AND LAYERED BACKING FOR DIMENSIONAL STABILITY AND INTEGRITY

[76] Inventor: Joseph R. Pacione, 127 Elgin Street, Thronhill, Ontario, Canada, L3T 1W7

[21] Appl. No.: 489,156

[22] Filed: Jun. 9, 1995

[51] Int. Cl.[6] ..... B32B 3/02; B32B 3/06

[52] U.S. Cl. ..... 428/95; 428/96; 428/97; 428/100; 428/101; 428/304.4

[58] Field of Search ..... 428/95, 96, 97, 428/100, 101, 304.4

[56] References Cited

U.S. PATENT DOCUMENTS

| | | | |
|---|---|---|---|
| 3,309,259 | 3/1967 | Schwartz | 428/96 |
| 3,322,607 | 5/1967 | Jung | 428/96 |
| 3,325,323 | 6/1967 | Forkner | 428/95 |
| 3,360,421 | 12/1967 | Sands | 428/95 |
| 3,414,458 | 12/1968 | Lacy | 428/95 |
| 4,093,763 | 6/1978 | Hartmann et al. | 428/95 |
| 4,096,302 | 6/1978 | Thibodeau et al. | 428/95 |
| 4,172,166 | 10/1979 | Hartmann et al. | 428/95 |
| 4,210,690 | 7/1980 | Hartmann et al. | 428/95 |
| 4,342,802 | 8/1982 | Pickens, Jr. et al. | 428/95 |
| 4,389,443 | 6/1983 | Thomas et al. | 428/95 |
| 4,390,582 | 6/1983 | Pickens, Jr. et al. | 428/95 |
| 4,391,866 | 7/1983 | Pickens, Jr. et al. | 428/95 |
| 4,412,877 | 11/1983 | Vosburgh | 428/95 |
| 4,522,857 | 6/1985 | Higgins | 428/95 |
| 4,622,253 | 11/1986 | Levy | 428/95 |
| 4,770,917 | 9/1988 | Tochacek et al. | 428/95 |
| 4,822,658 | 4/1989 | Pacione | 428/95 |
| 5,199,141 | 4/1993 | Trask et al. | 428/95 |
| 5,216,790 | 6/1993 | Eschenbach | 428/95 |
| 5,219,647 | 6/1993 | Vock et al. | 428/284 |
| 5,346,757 | 9/1994 | Nakata | 428/95 |

FOREIGN PATENT DOCUMENTS

| | | | |
|---|---|---|---|
| 0325473 | 7/1989 | European Pat. Off. | A44B 18/00 |
| 1006599 | 10/1965 | United Kingdom . | |
| 9400043 | 1/1994 | WIPO | A47G 27/04 |

*Primary Examiner*—Terrel Morris
*Attorney, Agent, or Firm*—Brian W. Gray; John C. Hunt

[57] ABSTRACT

A carpet structure and backing of superior dimensional stability and integrity which is especially useful in a free float system of installation. In one aspect of the invention, a carpet is provided having a selected dimensional stability in which there is (i) a first carpet part having a primary layer with pile substantially covering a first side of the layer, the pile tufted through the primary layer to leave tuft bundles on a second side of the primary layer and a binder encapsulating the tuft bundles, the first part having a predetermined force of expansion and contraction under cycling conditions of temperature and moisture; (ii) a second part in layered relationship to the first carpet part, the second carpet part constructed from one or more layers to have a predetermined resistance to expansion and contraction at least equal to or greater than the force of expansion and contraction of the first carpet part under cycling conditions of temperature and moisture and traffic loads on the carpet pile.

26 Claims, 5 Drawing Sheets

CARPET AND LAYERED BACKING FOR DIMENSIONAL STABILITY AND INTEGRITY

FIELD OF THE INVENTION

This invention relates to a new carpet structure with increased dimensional stability and integrity, and particularly one which is useful with a hook and loop installation system as disclosed in for example U.S. Pat. No. 4,822,658.

BACKGROUND OF THE INVENTION

Most carpets have some form of dimensional stability problems due to changes in temperature and humidity and also due, in some cases, to the lack of integrity from high traffic and heavy rolling stock etc. These problems are particularly acute when nylon is used as the primary pile layer since nylon absorbs moisture and expands up to approximately 6% of its weight. In many other ways, however, nylon is a preferred form of material for use in making carpet because of its durability and cost.

Typically nylon is used to make the pile of the carpet and it is tufted into a polypropylene primary backing to which it is bound by a predominantly latex binder applied to the underside of the backing.

The nylon pile tufted into the primary backing by itself is flexible and relatively stable, resisting buckling or wrinkling from atmospheric changes in moisture or temperature however, this intermediate product does not have the stability, mass or tuft bind to be a carpet. It is a mere piece of textile. Typically, integrity is added to this primary backing by the addition of a latex binder to bind the tuft bundles left below the primary backing together to add weight, stability and durability to the backing. However, as soon as this is done, problems can arise because of fiber growth in the primary pile due to atmospheric changes in relative humidity and temperature, leading to increased stress on the carpet as a whole. This can result in wrinkling, buckles and delamination, and in heavy traffic zones, reduce carpet integrity.

Attempts have been made to prevent the growing and distortion of some forms of carpet, especially carpet tiles or carpets of 6 feet width or less, by making it heavier and heavier and by locking the nylon of the pile into the backing more rigidly with more and more binder, adhesive or glue. Other attempts have been made to give greater dimensional stability to the carpet by putting fiberglass into the backing. While these attempts can create more dimensional stability, they do not completely satisfy the need for atmospheric stability and integrity for the great majority of carpets, particularly wide width carpets of greater than 6 feet. Most such carpets still require adhesion to the floor across substantially all of their underside, typically by gluing to maintain atmospheric stability and integrity. This construction thus makes it difficult to install a carpet in a "flee-float " system, i.e. one in which the carpet is installed only along its perimeter and seams.

As disclosed in U.S. Pat. No. 4,822,658, a method has been developed of installing a carpet through the use of a hook and loop system. The most economical form of such installation is the attachment of the carpet at the perimeter and along the seams. This is essentially a "free float system". It is therefore desirable in such a system to have a carpet of inherent dimensional stability and integrity, particularly under conditions of humidity changes and high traffic.

Also since carpet piles can differ, since the required stability and strength of carpets varies widely depending upon the anticipated use, and since cost plays a part in an item like carpet which is supplied in very large volume, it is desirable to have a series of constructions which can be used to engineer a carpet to a desired stability according to predetermined criteria so as to meet the anticipated conditions of use and cost. It is helpful if such constructions are able to be selected as required to achieve a predetermined selected dimensional stability and level of required integrity.

SUMMARY OF THE INVENTION

The invention is achieved in part by recognizing, on the one hand, that increasing binder weight and density on the underside of the primary layer aggravates, rather than alleviates, the atmospheric stability problem in carpets and by the further recognition that flexible dimensionally stable light weight secondary layers can be added as needed as backings to give the required stability to the primary layer.

The present invention provides a carpet structure and backing of superior dimensional stability and integrity which is especially useful in a free float system of installation.

In one aspect of the invention, a carpet is provided having a selected dimensional stability comprising:

(i) a first carpet part comprising a primary layer with pile substantially covering a first side of the layer, the pile tufted through the primary layer to leave tuft bundles on a second side of the primary layer and a binder encapsulating the tuft bundles, the first part having a predetermined force of expansion and contraction under cycling conditions of temperature and moisture;

(ii) a second part in layered relationship to the first carpet part, the second carpet part constructed from one or more layers to have a predetermined resistance to expansion and contraction at least equal to or greater than the force of expansion and contraction of the first carpet part under cycling conditions of temperature and moisture and traffic loads on the carpet pile.

In another aspect, carpet backing for use on a carpet to be installed on a floor by means of hooks complimentary and attachable to loops on the back of such backing is provided comprising:

(i) a first spun web layer;

(ii) loops needled into and through the first layer to substantially cover a first side of the layer with exposed loops;

(iii) a binder on the second side of the layer to lock the loops into the layer

In another aspect a carpet backing is provided for use on carpets to be installed on a floor by means of hooks complimentary and attachable to loops on the back of such backing comprising:

(i) a non-woven spun web polyester layer;

(ii) loops needled into and substantially covering a first side of the substrate;

(iii) means to lock the loops into the substrate.

A BRIEF DESCRIPTION OF THE DRAWINGS

Certain embodiments of the invention are described below with reference being made to the accompanying drawings wherein.

The carpet is rendered dimensionally stable by on the one hand matching the anticipated expansion and contraction of the first carpet part being the fibre pile the primary layer and the binder for the tuft bundles below the primary layer with a matching force of stability in the second carpet part composed of, preferably non-woven spun web polyester in sufficient layers. The predetermined stability is introduced by the number and type of layers, the material used for each layer, the use of woven or non-woven layers, thermally bonded, point bonded or not point bonded and the mass of binder and the degree of encapsulation of the tuft bundles. If less binder mass is used and if voids are provided around the tuft bundles then generally less atmospheric stability needs to be engineered into the backing.

Figure 1:
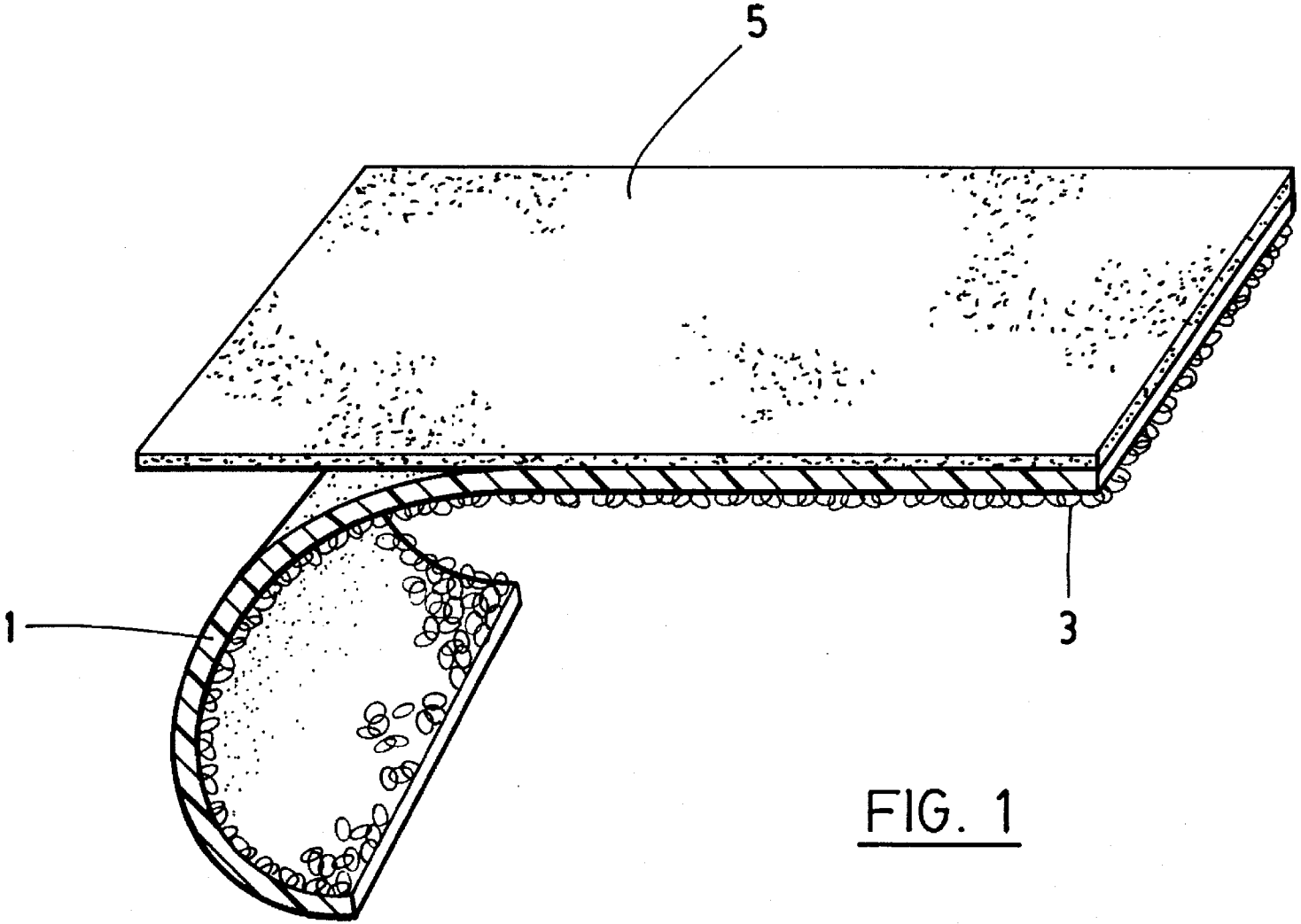
FIG. 1 is a sectional view of a carpet backing made in accordance with the present invention.

As shown in FIG. 1, there is provided a layer of, preferably, spun web polyester 1. This layer can be thermally bonded (for example, point bonded) or not depending upon the amount of stability required in the layer. Needled into the layer, preferably by the malimo process are loops 3, preferably made from polyester filaments. The loops are locked into the layer by a coating of a compatible binder 5 which preferably penetrates the spun web substrate layer sufficiently to encapsulate the loop fibers into the layer, but does not penetrate into the loops to substantially impair their ability to mesh with corresponding hooks for installation as described in U.S. Pat. No. 4,822,658.

Figure 2:
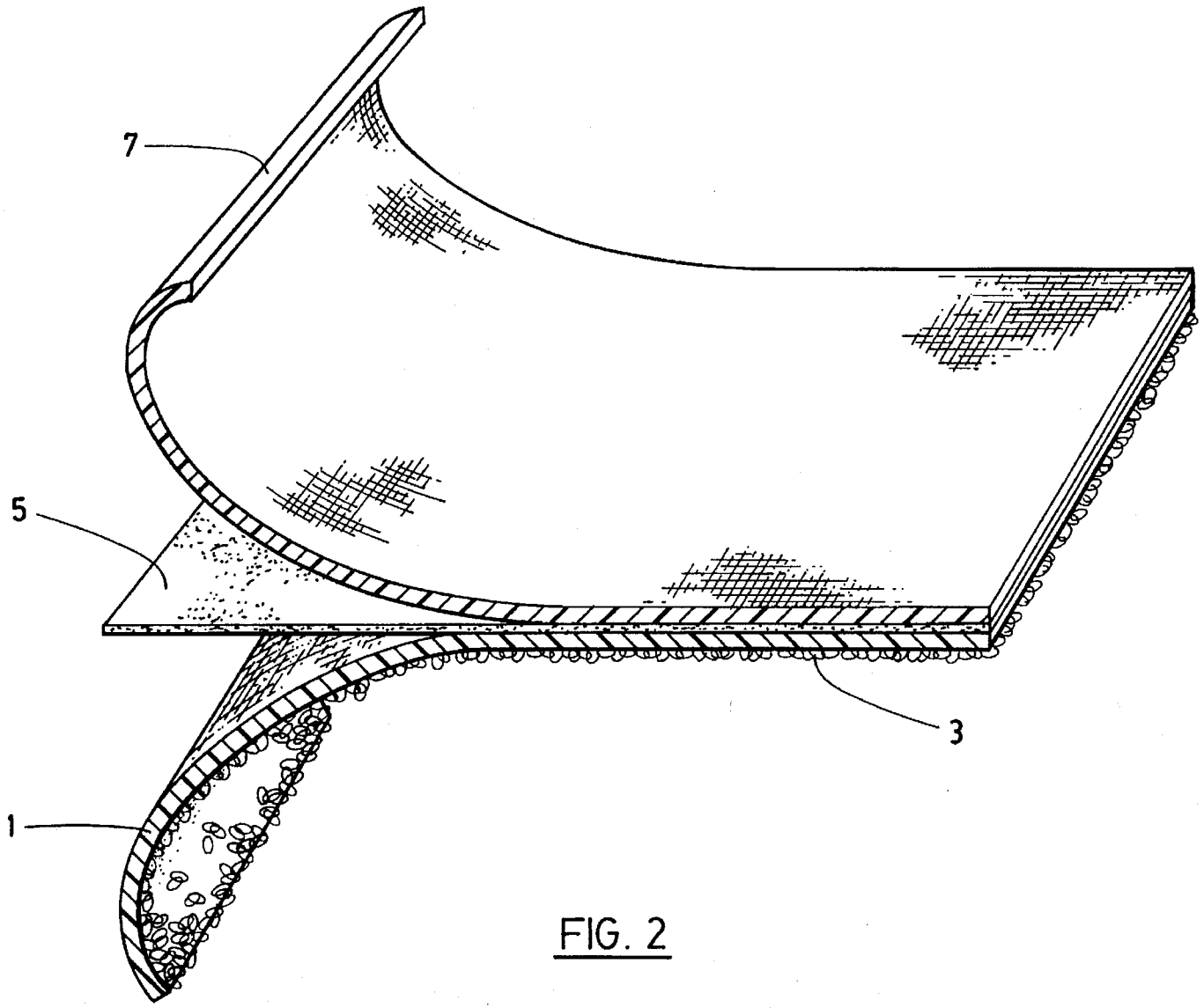
FIG. 2 is a backing having a second spun web layer.
Figure 3:
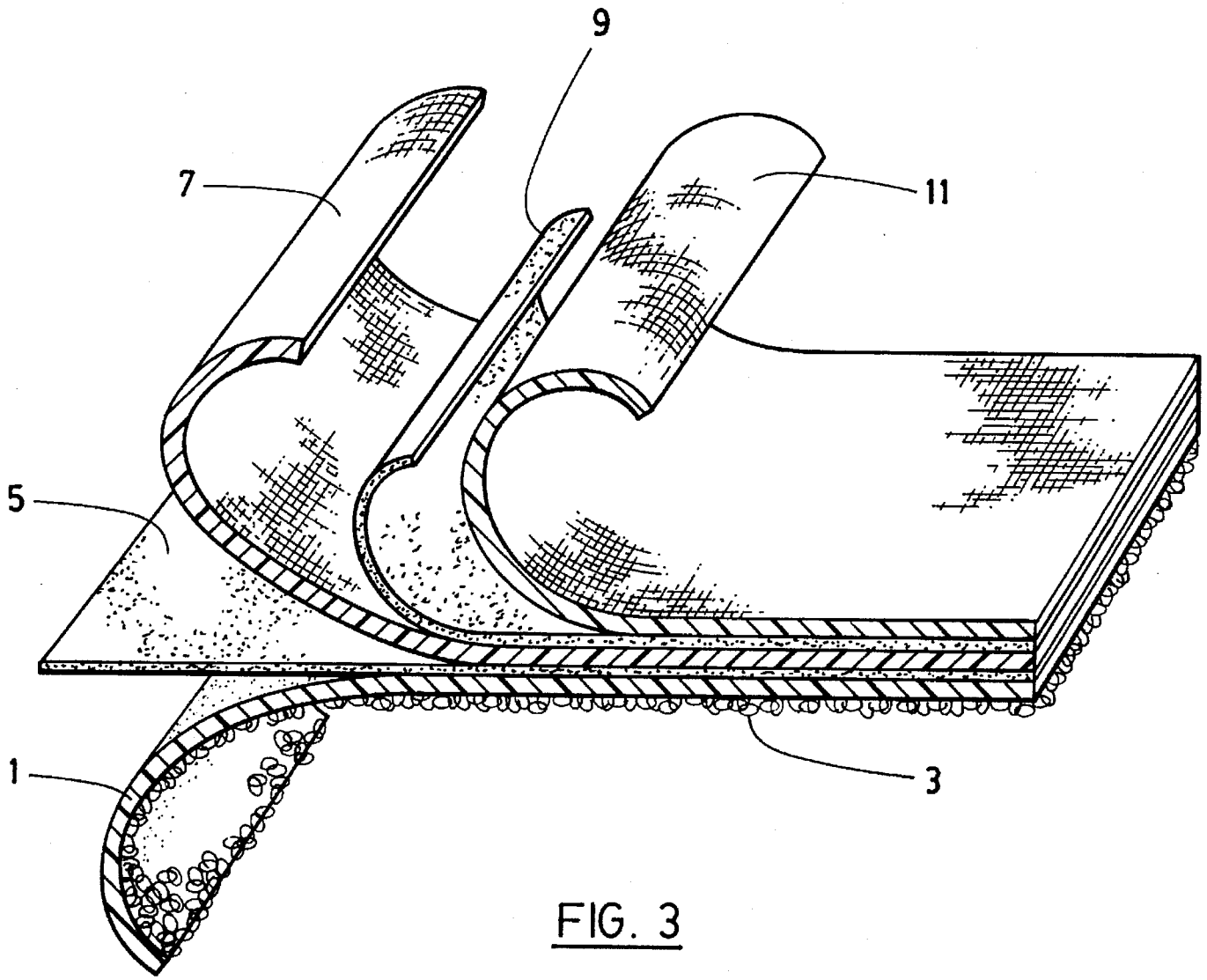
FIG. 3 is an alternative backing having two extra spun web layers.

In addition as disclosed in FIG. 2, the backing contains a first spun web layer 1, loops 3 and a binder or coating 5. An additional layer of the preferred spun web polyester 7 may be adhesively bonded to the first layer to add greater dimensional stability to the carpet backing. Further, other layers can be added as required as shown in FIG. 3 in which a second adhesive coating or binder 9 and a third layer of the preferred spun web polyester 11 are added.

It is also possible that the spun web layers may first be precoated prior to the addition of the adhesive or binder layers 5, 7 and 11 to limit the penetration of the adhesive or binder into the spun web layers, if that is desired.

Figure 4:
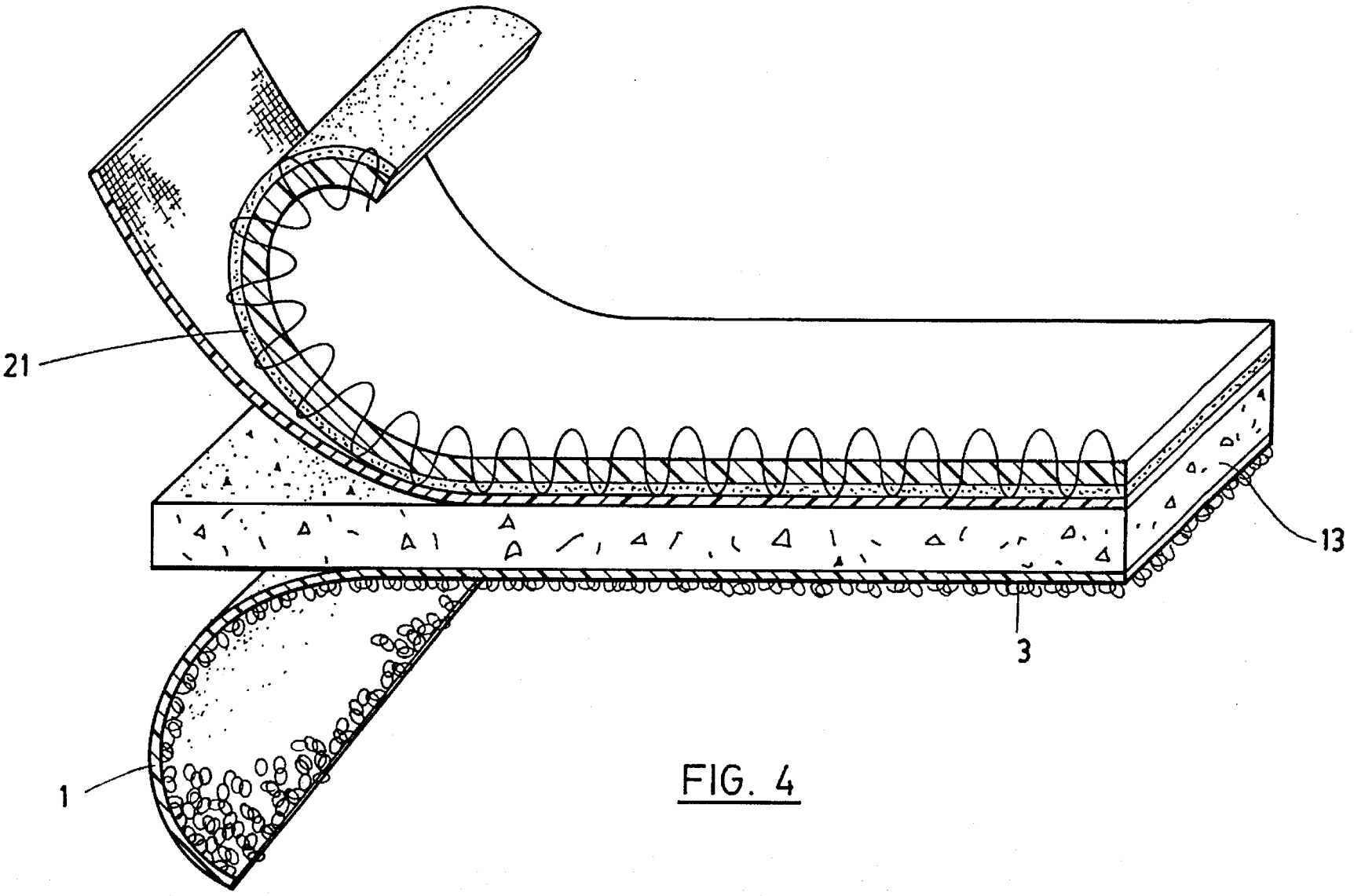
FIG. 4 is an alternative backing having a foam layer.

As shown in FIG. 4, a layer of polyurethane foam 13 can also be added both to provide cushioning and mass to the carpet. In this case, the binder or adhesive 5 would normally be applied to the spun web layer first to lock loops 3 into the bottom spun web layer and provide a coat for binding the foam layer to the other side of the substrate. Polyurethane foam is normally made by mechanical frothing or is chemically blown. In line or premanufactured slab foam may also be used.

Figure 5:
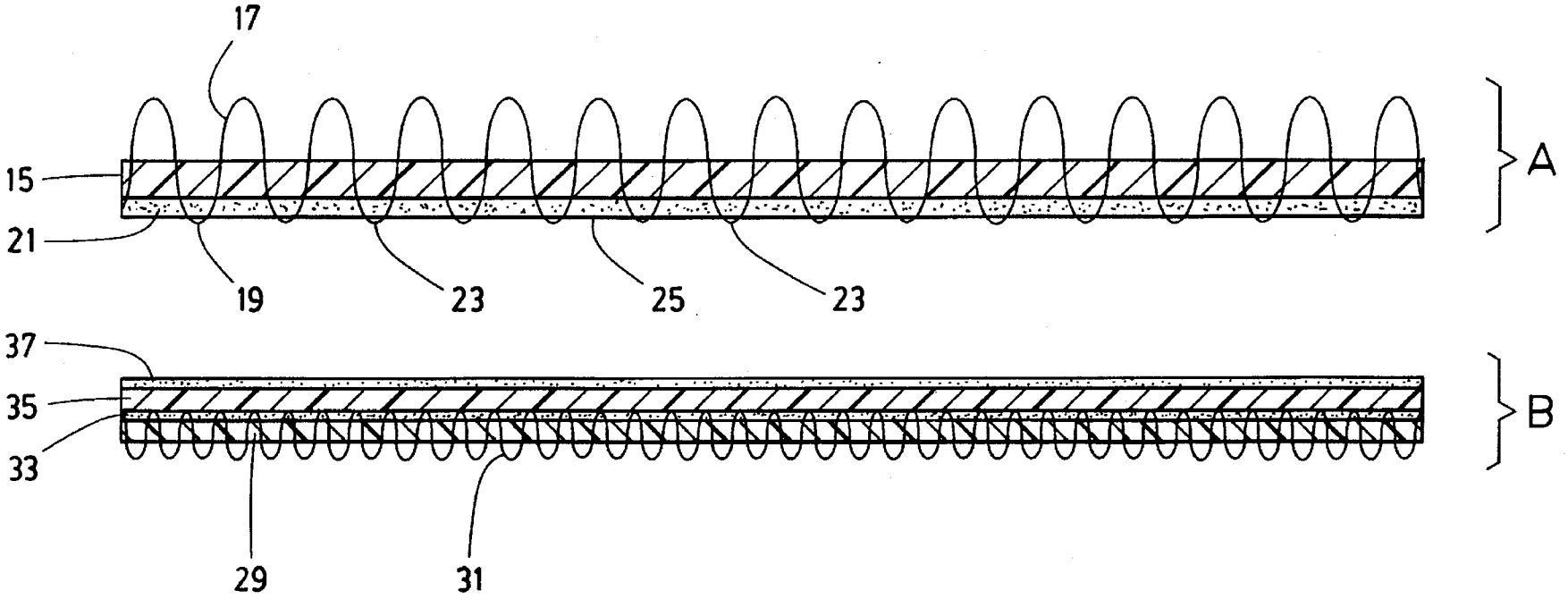
FIG. 5 is a sectional view of a carpet and backing in accordance with this invention.

Shown in FIG. 5 is one form of carpet which can be made using this invention. It should be recognized that any of the backings shown in FIGS. 1–4 could be used with the carpet construction of this invention as long as the predetermined expansion and contraction of the first carpet part, shown as A in FIG. 5 under cycling conditions of temperature and moisture (humidity) is at least equalled or exceeded by the predetermined resistance to expansion and contraction of the second carpet part "B" shown in FIG. 5.

As shown in FIG. 5, the first carpet part consists of a polypropylene backing 15 and nylon pile 17 which has been tufted through the backing normally in a continuous strand.

Such tufting leaves tuft bundles 19 below the primary layer 15. The ability of these tuft bundles 19 to expand and contract plays a significant role in the tendency of the first carpet part A to buckle under changes in temperature or humidity. Some form of binder is necessary to achieve any degree of tuft bind, i.e. a situation in which the nylon tufts 17 cannot easily be pulled from the backing 15. Thus the tuft bundles 19 are encapsulated to the minimum extent necessary in a binder 21 which is typically polyurethane. The amount of polyurethane should be minimized, preferably so that the layer 21 does not extend beyond the tops 23 of the tuft bundles. This can be achieved in pan by the use of a doctor blade after application of the binder and before it has set. The doctor blade wipes along the surface created by the tops of the tuft bundles and to some extend within the valleys 25 to minimize the amount of binder 21 on the first carpet part A. If possible, some voids or spaces, such as at 25, may be left.

The second carpet part B has a backing of preferably spun web polyester. In this case where the carpet is to be installed in accordance with the system disclosed in U.S. Pat. No. 4,822,658, the backing will have needled filaments or loops 31. Such loops are normally locked into the backing 29 by a binder or adhesive 33 applied to the back of backing 29 opposite the exposed loops 31, a second spun web layer 35 may be added and attached to layer 29 by the binder 33 or an additional binder or adhesive (not shown) may be added after binder 33 has cured. The whole of second carpet part B will normally be attached to a first carpet part A by a light adhesive or binder coat 37. Such binder coat is normally kept to the minimum in order to maintain some voids or spaces around the tuft bundles.

Depending upon the method used to tuft the pile into the primary layer of the carpet, and the style of carpet, a significant number of nylon filaments will be located below the backing. The amount of filament which remains below the carpet backing is determined to a large extent by the type of stitch used in the manufacture of the carpet. With a straight stitch 10–15% remains below the carpet, whereas with a graphic stitch the amount can be as much as 50% or more. In any event, whether they are calculated by theoretical expansion or by actual tests, the exact degree of expansion and contraction under conditions of temperature and humidity of the first carpet part A can be determined. The preferred way is to wet the first carpet part under relatively warm conditions and allow the carpet to expand to its maximum width. The piece can then be fixed in place at its edges and the contraction force can then be determined.

When this force is known, the amount of stability needed in the second carpet part or secondary backing to resist this force will then be known. The second carpet part can first be tested for stability by simple pull tests by placing such part in tension along any dimension and applying pulling force.

The carpet backing can simply be layered as required with woven or non-woven material and preferably thermally bonded, point bonded or non-point bonded spun web material, more preferably polyester. Such material is flexible, lightweight and not rigid, but it resists movement in the plane of the layer. A layer of slab foam or mechanically frothed foam can also be interposed.

What is claimed is:

1. A carpet backing for use on a carpet to be installed on a floor by means of hooks complementary and attachable to loops on the back of such backing comprising:

(i) a first spun web substrate layer having opposite first and second sides;

(ii) loops needled into and through the first layer to substantially cover the first side of the substrate layer with exposed loops;

(iii) a precoating applied to the second side of the substrate; and (iv) a binder on the second side of the substrate to lock the loops into the substrate, wherein the precoating reduces penetration of the binder into the substrate.

2. The backing of claim 1 in which the substrate is thermally bonded to stabilize the substrate.

3. The backing of claim 2 in which the substrate is point bonded.

4. The backing of claim 3 in which the substrate is non-woven.

5. The backing of claim 4 in which a second layer of spun web substrate is adhered to the first layer on the side opposite the exposed loops.

6. The backing of claim 5 in which the binder also bonds the first and second layers together.

7. The backing of claim 6 in which the second layer is non-woven.

8. The backing of claim 7 in which the second layer is point bonded.

9. The backing of claim 8 in which additional spun web layers are adhered as needed to create a carpet of a selected dimensional stability.

10. The backing of claim 4 in which the first layer is spun web non-woven thermally bonded polyester.

11. The backing of claim 10 in which the binder contains a fire retardant chemical treatment.

12. The backing of claim 10 in which the loops are needled into the first layer by the malimo process.

13. The backing of claim 4 in which the mount and viscosity of the binder on the second side of such substrate is matched with the density of the substrate so that such binder penetrates both sides of the substrate to lock the loops into the substrate but without clogging the loops on the first side.

14. A carpet having a selected dimensional stability comprising:

(i) a first carpet part comprising a primary layer with pile substantially covering a first side of the layer, the pile tufted through the primary layer to leave tuft bundles on a second side of the primary layer and a binder encapsulating the tuft bundles in which the binder contains voids within and around the tuft bundles to allow for expansion and contraction of the bundles;

(ii) a second part in layered relationship to the first carpet part, the second carpet part constructed from one or more layers to have a predetermined resistance to expansion and contraction at least equal to or greater than the force of expansion and contraction of the first carpet part under cycling conditions of temperature and moisture and traffic loads on the carpet pile.

15. The carpet of claim 14 in which the second carpet part is constructed from one or more layers of the following:

(a) a woven layer (b) a non-woven layer (c) a foam layer and a binder chemically compatible to and interposed between the layers to bind the layers together.

16. The carpet of claim 15 in which the binder encapsulates the tuft bundles and does not form a layer substantially deeper than the tops of the tuft bundles.

17. The carpet of claim 15 in which the the second carpet part is the non-woven layer and the non-woven layer is spun web.

18. The carpet of claim 17 in which the spun web layer is thermally bonded.

19. The carpet of claim 17 in which the spun web layer is point bonded.

20. The carpet of claim 14 in which there is needled into a bottom layer loops substantially covering an underside of the bottom layer.

21. The carpet of claim 20 in which the loops are locked to the bottom layer by the binder binding such layer to the layer above.

22. A carpet backing for use on carpets to be installed on a floor by means of hooks complementary and attachable to loops on the back of such backing comprising.

(i) non-woven spun web polyester substraate having opposite first and second sides;

(ii) loops needled into and substantially covering the first side of the substrate;

(iii) a precoating applied to the second side of the substrate; and (iv) a binder to lock the loops into the substrate, wherein the precoating reduces penetration of the binder into the substraate.

23. The backing of claim 22 in which the amount and viscosity of the binder are matched with the density of the substrate so that such binder penetrates both sides of the substrate to lock the loops into the substrate but without clogging the loops on the first side.

24. The backing of claim 23 in which the substrate is stabilized by point bonding.

25. The backing of claim 22 in which a foam layer is bonded to the non-woven spun web substrate on the side opposite the loops.

26. The backing of claim 25 in which the foam layer has voids or spaces to match the expansion and contration of the carpet backing.

* * * * *